United States Patent [19]

Tune

[11] 4,441,620

[45] Apr. 10, 1984

[54] HEATSEAL PLUG WITH RESEALING FEATURE

[75] Inventor: Joel A. Tune, Lake Villa, Ill.

[73] Assignee: Baxter Travenol Laboratories, Inc., Deerfield, Ill.

[21] Appl. No.: 392,681

[22] Filed: Jun. 28, 1982

[51] Int. Cl.[3] ..... B65D 41/32

[52] U.S. Cl. ..... 215/232

[58] Field of Search ..... 215/232, 295, 250, 253

[56] References Cited

U.S. PATENT DOCUMENTS

| | | | |
|---|---|---|---|
| 3,430,798 | 3/1969 | Goyet et al. | 215/295 |
| 3,804,282 | 4/1974 | Komendowski | 215/32 |
| 3,923,185 | 12/1975 | Choksi et al. | 215/253 |
| 3,945,525 | 3/1976 | Jones | 215/232 |
| 4,091,949 | 5/1978 | Fowles et al. | 215/232 X |
| 4,096,962 | 6/1978 | Riuli et al. | 215/250 X |
| 4,111,325 | 9/1978 | Bellamy et al. | 215/232 |
| 4,176,755 | 12/1979 | Winchell | 215/32 |
| 4,236,646 | 12/1980 | Ganz et al. | 215/232 |

*Primary Examiner*—Donald F. Norton

*Attorney, Agent, or Firm*—John P. Kirby, Jr.; Bradford R. L. Price; Gerald S. Geren

[57] ABSTRACT

There is disclosed herein an improved hermetically sealed container and closure assembly for storing and dispensing sterile liquids. The container includes a bottle having a neck which defines an outlet or mouth, a set of external threads adjacent the outlet and transverse abutment shoulder means on said neck and spaced from the outlet. The closure includes an externally threaded cup-shaped overcap having a generally cylindrically-shaped side wall, a top wall for positioning across the bottle mouth and wiper means depending from said top wall for sealing in cooperation with said outlet. The overcap is hermetically bonded to the bottle neck. An outer jacking ring is provided which is threadedly interfitted over the overcap and adapted for counterclockwise rotation to engage the abutment means and cause the overcap to move axially upwardly from the bottle outlet.

Ramp-like cam means are provided on the neck for cooperation in sealing the wiper means to the bottle outlet. Shoulder means are provided on the overcap for engaging the ramp-like cam means and causing the overcap to distort and thereby enhance sealing of the wiper means to the outlet.

6 Claims, 5 Drawing Figures

FIG. 1
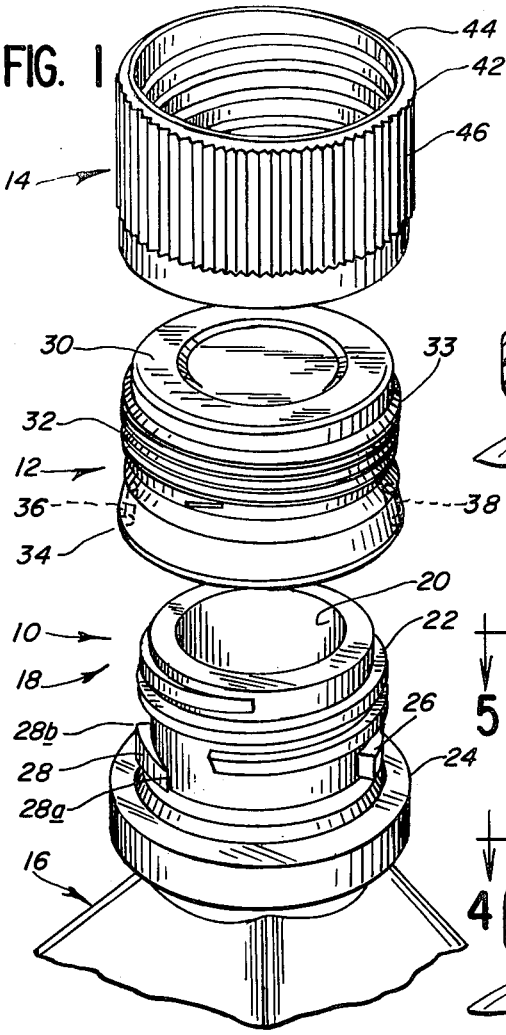
FIG. 2
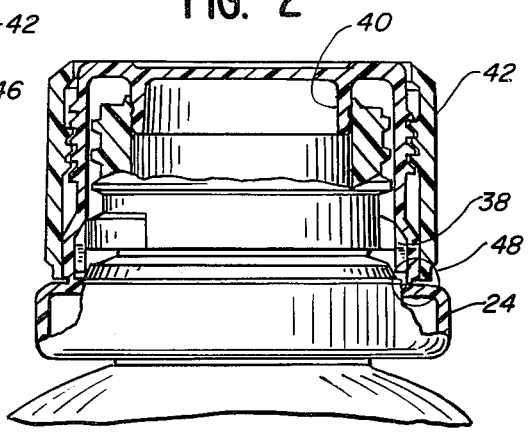
FIG. 3
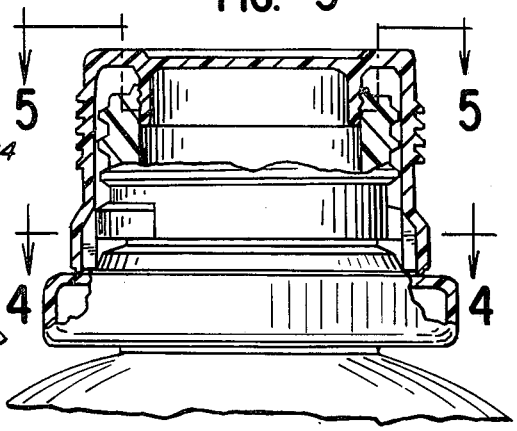
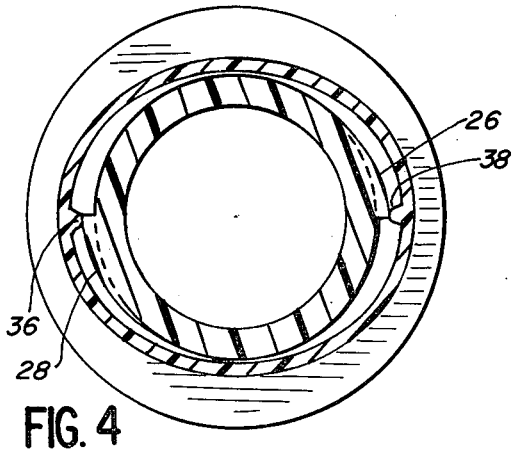
FIG. 4
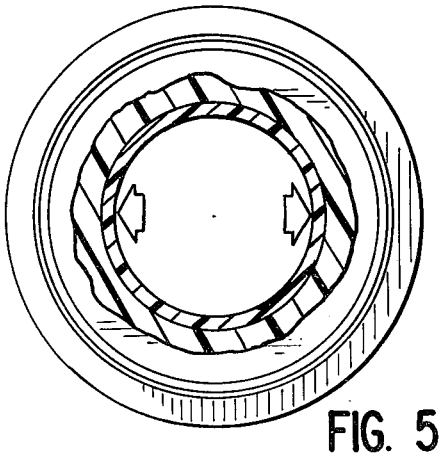
FIG. 5

HEATSEAL PLUG WITH RESEALING FEATURE

BACKGROUND OF THE INVENTION

This invention relates to a hermetically sealed container, and more particularly, to containers for carrying and dispensing sterile liquids.

Containers for storing and dispensing sterile liquids are shown in the art. Such containers are commonly used in hospitals for administering solutions, such as irrigating solutions. These containers must keep the solution sterile during storage, shipping and dispensing. Furthermore, the closure system must be convenient to open, preferably by the usual counterclockwise rotation of the cap. Some closure systems include an overcap which is frangibly molded to the container neck and a jacking ring which threadedly engages the overcap. Rotation of the jacking ring causes the overcap's frangible connection to the bottle to fracture and thereafter lifts the overcap from the bottle outlet so as to open the bottle.

In many hospital procedures the container is not to be reused and is thus discarded after being opened. However, in some situations the container can be reused. In such circumstances the overcap is provided with a sealing member which permits resealing. U.S. Pat. No. 4,236,646 discloses one such reusable and resealable closure.

It is the object of this invention to provide an improved resealing feature.

This and other objects of this invention will become apparent from the following description and appended claims.

SUMMARY OF THE INVENTION

There is disclosed herein a resealable, tamper-proof bottle closure which includes the bottle neck, an overcap and jacking ring.

The overcap includes wiper means which sealingly engages the inner surface of the bottle neck. In order to enhance resealing, ramp-like cam means are provided on the bottle neck and internal shoulder-like means are provided on the inner surface of the overcap. By tightening the overcap onto the neck, the shoulders ride against the ramp-like means, thereby causing the cap to distort to an oval shape which, in turn, causes the wiper to distort and enhance sealing.

BRIEF DESCRIPTION OF THE DRAWINGS

FIG. 1 is an exploded perspective view showing a bottle neck, overcap and jacking ring;

FIG. 2 is an elevational view partially in section showing the overcap on the bottle neck with the jacking ring;

FIG. 3 shows an overcap resealed to the bottle with the shoulders and ramps engaged to distort the overcap and wiper seal;

FIG. 4 is a cross-sectional view taken along line 4—4 of FIG. 3 showing the ramp and shoulders engaged to distort the cap; and FIG. 5 is a cross-sectional view showing sealing of the wiper to the bottle neck.

DESCRIPTION OF THE PREFERRED EMBODIMENT

Referring now to the drawings, the bottle and closure mechanism is shown in FIG. 1, with the bottle and neck shown generally at 10, the overcap at 12 and jacking ring at 14. The bottle 16 includes a neck 18, the terminal end of which defines a mouth or outlet 20. A set of standard external threads 22, which permit counterclockwise tightening, are provided adjacent the outlet 20. These threads can cooperate with other internally-threaded hospital appliances for delivering or using the solutions in the bottle. A ring-like thrust and frangible connector shoulder 24 is positioned on the neck adjacent the bottle body and spaced from the threads 22.

A pair of resealing tightening cam-like ramps 26 and 28 are also molded onto the neck and are positioned between the threads 22 and shoulder 24. The ramps are diametrically opposed to each other and are tapered. The leading edge **28*a* of the taper is positioned counterclockwise from the raised terminal end 28*b*. Thus the ramps utilize the same counterclockwise rotation for tightening and resealing as do the threads 22** for tightening.

The overcap 12 is a molded cup-like member having a top wall 30 and a downwardly-extending cylindrical side wall 32 which terminates in an outwardly flaring skirt 34. The lower edge of the skirt is molded to the thrust shoulder 24 to form a sterile but frangible seal. A pair of diametrically opposed internally and axially extending tightening shoulders 36 and 38 are provided on the inner surface of said skirt for tightening cooperation with the cam-like ramps 26 and 28 on the bottle neck. A depending cylindrically-shaped wiper seal 40, as shown in FIG. 2, extends from the top wall 30 into the cap interior.

The jacking ring 14 is an open-ended tubular and cylindrical member which includes a wall 42 that has internal threads 44 for threaded cooperation with the overcap threads 33. The jacking ring also includes a beveled or knurled outer surface 46 for ease in grasping and turning of the jacking ring.

The bottle and closure are formed and the bottle is then filled. The overcap 12 is then sealed to the thrust ring 24 at a frangible seal 48 as shown in FIG. 2. The cooperation of the wiper 40 and frangible seal 48 maintain the initial sterility of the bottle and contained liquids. The jacking ring is then threaded onto the overcap. The assembled bottle is then shipped for its distribution.

In order to open the bottle, the jacking ring 14 is rotated in the counterclockwise direction and its interaction with the overcap threads causes it to move axially downwardly against the thrust ring 24. Further counterclockwise rotation of the jacking ring and the interaction with the overcap threads urges the overcap axially upwardly away from the bottle neck. This movement eventually causes the tamper-proof frangible seal 48 to fracture and lifts the overcap and disengages the wiper seal 40 so as to open the bottle and permit dispensing of the liquid from the container.

In order to reseal the container, the overcap 12 is fitted onto the bottle neck and the wiper seal 40 is fitted into bottle mouth 20. The overcap 12 is then rotated so that the shoulders 36 and 38 engage and ride up on the cam-like ramps 26 and 28. This causes the overcap 12 to distort to an oval shape which, in turn, causes the wiper seal 40 to distort. This distortion in turn seals the wiper tightly against the inner surface of the bottle mouth, thereby effecting a secure liquid tight reseal.

The jacking ring is then refitted onto the overcap and the bottle is then ready for reuse.

It will be appreciated that numerous changes and modifications can be made to the embodiment shown herein without departing from the spirit and scope of this invention.

What is claimed is:

1. An improved hermetically sealed container and closure assembly for storing and dispensing sterile liquids, said container including a bottle having a neck which includes an outlet or mouth, a set of external threads adjacent said outlet, and a transverse abutment shoulder on the neck and spaced from said outlet; said closure including an externally threaded cup-shaped overcap having a generally cylindrically shaped side wall, a top wall for positioning across said bottle outlet and wiper means depending from said top wall for sealing cooperation with said outlet, said cap being hermetically bonded to said bottle neck; and said closure also including an outer jacking ring threadedly interfitting over said overcap and adapted for counterclockwise downward rotation to engage said abutment shoulder and cause said overcap to move axially upwardly from said bottle outlet;

wherein the improvement comprises there being provided:

ramp-like cam means on said neck for cooperation in sealing said wiper means to said bottle outlet; and shoulder means on said overcap for engaging said ramp-like cam means, causing said overcap to distort and thereby enhancing the sealing of the wiper means to said outlet.

2. A container as in claim 1, wherein said ramp-like means are positioned on said bottle neck between the abutment shoulder and the threads on said neck.

3. A container as in claim 2, wherein said ramp-like means tapers circumferentially outwardly from said neck and are constructed to be engaged by said shoulder means upon counterclockwise rotation of said overcap.

4. A container as in claim 2, wherein there are provided two diametrically opposed ramp-like cam means.

5. A container as in claim 1, wherein said overcap includes a flared skirt-like portion at its open end, said shoulder means being formed on said skirt-like portion, extending inwardly from said skirt-like portion and axially upwardly from the lower edge of the skirt-like portion and constructed to engage said ramp-like cam means and cooperate with said ramp-like cam means to cause said cap to distort.

6. A container as in claim 1, wherein said shoulder means comprise a pair of camming shoulders spaced 180° from each other for cooperation with said ramp-like cam means to distort the overcap.

* * * * *